US011542112B2

(12) United States Patent
Nakano et al.

(10) Patent No.: US 11,542,112 B2
(45) Date of Patent: Jan. 3, 2023

(54) SHEET FEEDING DEVICE AND IMAGE FORMING APPARATUS INCORPORATING SAME

(71) Applicant: Ricoh Company, Ltd., Tokyo (JP)

(72) Inventors: Takashi Nakano, Kanagawa (JP); Hikaru Fukasawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 170 days.

(21) Appl. No.: 16/950,259

(22) Filed: Nov. 17, 2020

(65) Prior Publication Data

US 2021/0163246 A1 Jun. 3, 2021

(30) Foreign Application Priority Data

Nov. 29, 2019 (JP) ..... JP2019-216699
Oct. 12, 2020 (JP) ..... JP2020-172171

(51) Int. Cl.

| | |
|---|---|
| ***B65H 7/14*** | (2006.01) |
| ***B65H 1/04*** | (2006.01) |
| ***G03G 15/00*** | (2006.01) |
| ***B65H 1/08*** | (2006.01) |
| ***B41J 11/00*** | (2006.01) |
| ***B65H 3/14*** | (2006.01) |

(52) U.S. Cl.

CPC ..... *B65H 7/14* (2013.01); *B41J 11/007* (2013.01); *B65H 1/04* (2013.01); *B65H 1/08* (2013.01); *B65H 3/14* (2013.01); *G03G 15/6529* (2013.01)

(58) Field of Classification Search

CPC combination set(s) only.
See application file for complete search history.

(56) References Cited

U.S. PATENT DOCUMENTS

| | | | | |
|---|---|---|---|---|
| 2008/0036134 | A1 | 2/2008 | Matsumoto | |
| 2009/0236794 | A1 | 9/2009 | Tsukamoto et al. | |
| 2009/0256304 | A1* | 10/2009 | Koizumi | B65H 7/18 271/145 |
| 2010/0296852 | A1 | 11/2010 | Higaki | |
| 2010/0329758 | A1 | 12/2010 | Yoshimura et al. | |
| 2014/0084531 | A1 | 3/2014 | Fukumoto et al. | |
| 2014/0191461 | A1 | 7/2014 | Umemoto et al. | |
| 2014/0265105 | A1 | 9/2014 | Shimoyama et al. | |
| 2015/0021848 | A1 | 1/2015 | Mizuno et al. | |
| 2015/0048566 | A1 | 2/2015 | Utagawa et al. | |
| 2015/0145199 | A1 | 5/2015 | Yoshida et al. | |
| 2018/0327202 | A1 | 11/2018 | Nakamura | |

(Continued)

FOREIGN PATENT DOCUMENTS

| | | | |
|---|---|---|---|
| CN | 101075105 | A | 11/2007 |
| CN | 101539733 | A | 9/2009 |
| CN | 101891069 | A | 11/2010 |

(Continued)

OTHER PUBLICATIONS

Office Action dated May 18, 2022 in Chinese Patent Application No. 202011299290.6, 7 pages.

*Primary Examiner* — Jennifer Bahls
(74) *Attorney, Agent, or Firm* — Xsensus LLP

(57) ABSTRACT

A sheet feeding device includes a sheet loading table on which a bundle of sheets is stacked, an identification mark on an end face of the sheet loading table, and an imaging unit to identify the identification mark.

10 Claims, 11 Drawing Sheets

(56) References Cited

U.S. PATENT DOCUMENTS

2019/0202647 A1* 7/2019 Sugawara ..... B65H 7/04

FOREIGN PATENT DOCUMENTS

| | | | | |
|---|---|---|---|---|
| CN | 101927912 | A | | 12/2010 |
| CN | 103922164 | A | | 7/2014 |
| CN | 104058277 | A | | 9/2014 |
| CN | 104291133 | A | | 1/2015 |
| CN | 106276252 | A | | 1/2017 |
| CN | 108861693 | A | | 11/2018 |
| JP | 2001-301997 | A | | 10/2001 |
| JP | 2005041678 | A | * | 2/2005 |
| JP | 2005-104723 | | | 4/2005 |
| JP | 2008-297021 | | | 12/2008 |
| JP | 2014-133626 | A | | 7/2014 |

* cited by examiner

COMPARATIVE EXAMPLE

SHEET FEEDING DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application Nos. 2019-216699, filed on Nov. 29, 2019 and 2020-172171, filed on Oct. 12, 2020, in the Japan Patent Office, the entire disclosure of each of which is hereby incorporated by reference herein.

BACKGROUND

Technical Field

Embodiments of the present disclosure relate to a sheet feeding device and an image forming apparatus including the sheet feeding device.

Description of the Related Art

There is known a sheet feeding device including an imaging unit and a sheet loading portion.

SUMMARY

Embodiments of the present disclosure describe an improved sheet feeding device that includes a sheet loading table on which a bundle of sheets is stacked, an identification mark on an end face of the sheet loading table, and an imaging unit to identify the identification mark.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
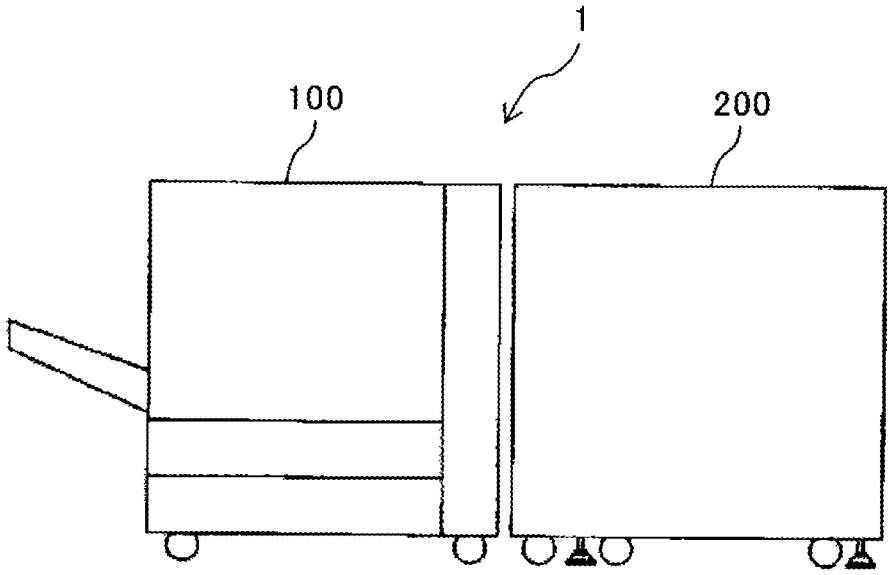
FIG. 1 is a schematic view illustrating a configuration of an image forming apparatus including a sheet feeding device according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

A certain sheet feeding device include a supply tray, a sheet separation feeder, and an imaging unit. The supply tray accommodates a bundle of sheets that is a plurality of recording sheets piled one on another. A bottom plate of the supply tray is a sheet loading portion on which the bundle of sheets is stacked. The sheet separation feeder separates and feeds the recording sheets in the supply tray one by one. The imaging unit captures an image of the bundle of sheets set in the supply tray from the side of the bundle of sheets.

In such a sheet feeding device, the bottom plate in the supply tray is progressively lifted so that an imaging range of the imaging unit includes an end face of the bottom plate. In this case, the sheet feeding device can recognize that image data contains an image that is clearly different from the side of the bundle of sheets and determine that the remaining amount of the recording sheets set in the supply tray is low. However, there is still room for improvement in the accuracy of detecting the position of the sheet loading portion.

A description is given below of a sheet feeding device according to an embodiment of the present disclosure. FIG. 1 is a schematic view illustrating a configuration of an image forming apparatus 1 including a sheet feeding device 200 according to the present embodiment. As illustrated in FIG. 1, the image forming apparatus 1 includes an apparatus body 100 as an image forming device to form an image on a sheet and the sheet feeding device 200 to feed the sheet to the apparatus body 100. The sheet feeding device 200 is disposed on the side of the apparatus body 100.

The recording method of the apparatus body 100 is not particularly limited, and any method such as an electrophotographic method and an inkjet method can be adopted. A sheet inlet portion is disposed on the right side face of the apparatus body 100 in FIG. 1 to introduce the sheet from the sheet feeding device 200. An opening to introduce the sheet and a conveyor to convey the sheet are disposed at the sheet inlet portion.

Figure 2:
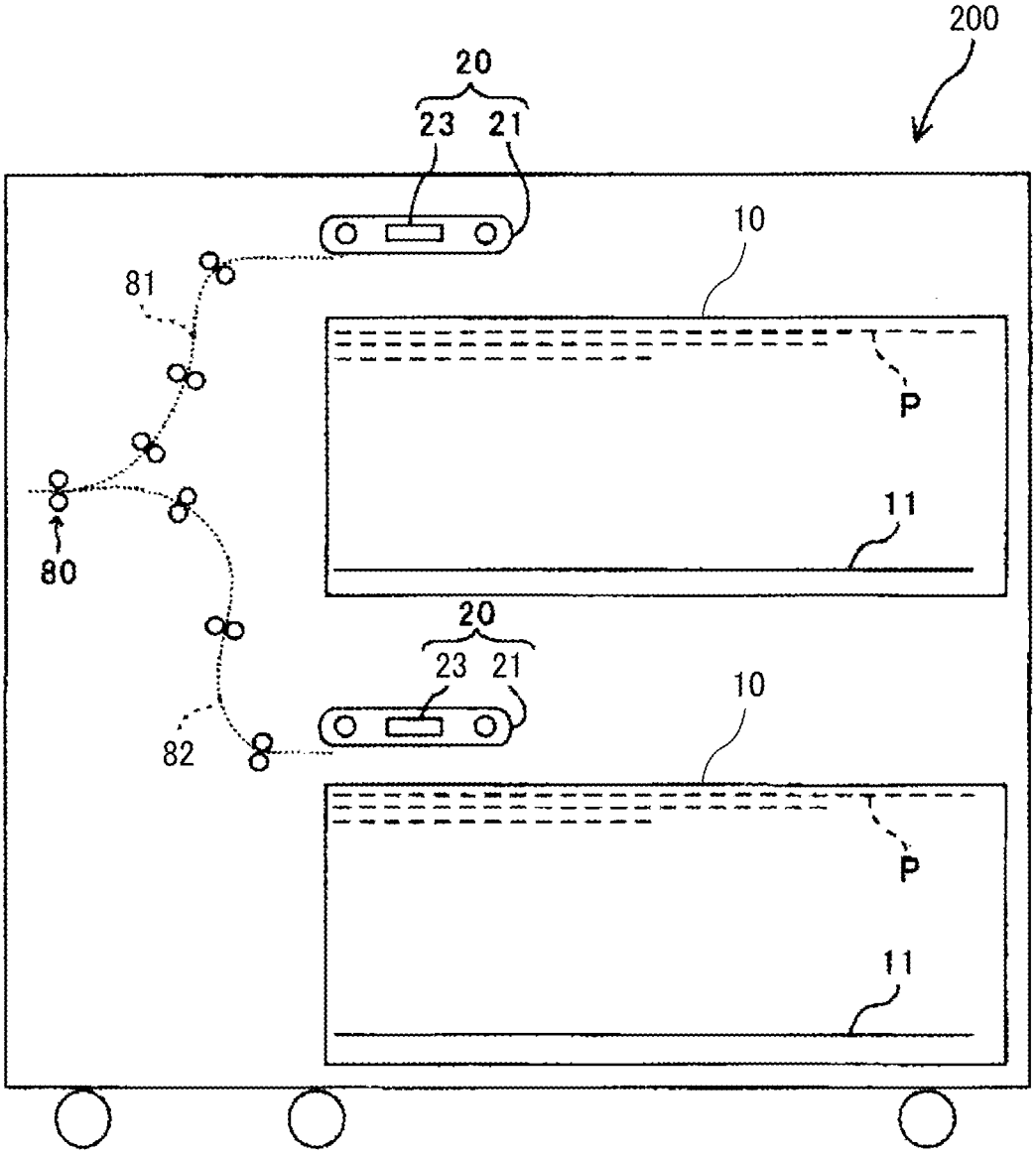
FIG. 2 is a schematic view of the sheet feeding device in FIG. 1.

FIG. 2 is a schematic view of the sheet feeding device 200. As illustrated in FIG. 2, the sheet feeding device 200 includes two-stage, upper and lower accommodation trays 10. Each of the accommodation trays 10 includes a sheet loading table 11 as a sheet loading portion on which a bundle of sheets P is stacked and can accommodate, for example, a maximum of about 2500 sheets.

Here, examples of the term "sheet" include paper sheets, coated paper, label paper, overhead projector (OHP) transparencies, films, and prepregs. The prepreg is mainly used as a material for a laminated board or a multilayer printed wiring board. The prepreg is a sheet material. For example, a long base material, such as glass cloth, paper, non-woven fabric, or aramid cloth, is continuously impregnated with a resin varnish mainly including a thermosetting resin, such as an epoxy resin or a polyimide resin. The long base material is heated, dried, and cut, and is thus processed into the sheet material.

A feeding unit 20 as a feeder is disposed above each of the accommodation trays 10 to separate and feed the sheets P stacked in the accommodation tray 10. The feeding unit 20 includes a suction belt 21 and a suction device 23 as a conveyor. The sheets P stacked in the lower accommodation tray 10 are conveyed to the apparatus body 100 by an exit roller pair 80 through a lower conveyance path 82. The sheets P stacked in the upper accommodation tray 10 are conveyed to the apparatus body 100 by the exit roller pair 80 through an upper conveyance path 81.

Figure 3:
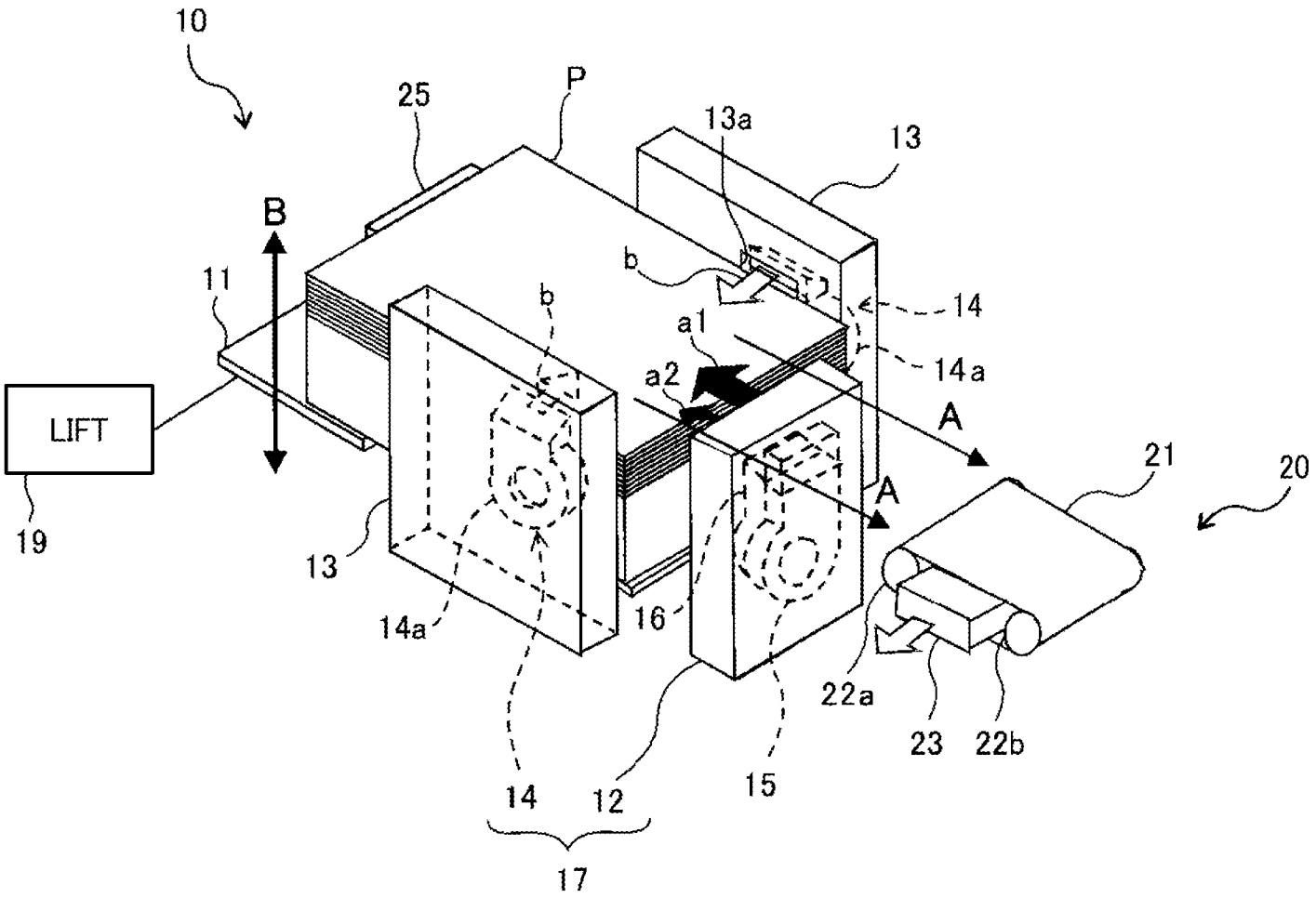
FIG. 3 is a schematic perspective view of an accommodation tray of the sheet feeding device.

FIG. 3 is a schematic perspective view of the accommodation tray 10 of the sheet feeding device 200. In FIG. 3, the feeding unit 20 is depicted at the position shifted from the original location in the direction indicated by arrow A for easy understanding. The suction belt 21 of the feeding unit 20 is stretched around two stretch rollers 22*a* and 22*b*. The suction belt 21 includes suction holes in the entire region in the circumferential direction of the suction belt 21. The suction holes penetrate the suction belt 21 from the front surface to the back surface. The suction device 23 is disposed inside the suction belt 21. The suction device 23 is coupled to a suction fan to suck air via an air duct that is a flow passage of air and generates a negative pressure below the feeding unit 20 to attract the sheet P onto the lower surface of the suction belt 21. The air sucked by the suction device 23 is called suction air.

The accommodation tray 10 is provided with a blower device 17 to blow air onto upper sheets P of the bundle of sheets P. The blower device 17 includes a front blower unit 12 and side blower units 14. The front blower unit 12 blows air onto a leading end (a downstream end in a feed direction of the sheet P) of the upper portion of the bundle of sheets P. The front blower unit 12 includes a levitation nozzle, a separation nozzle, a levitation blower 15, and a separation blower 16. The levitation nozzle guides air in the direction to levitate the bundle of sheets P. The separation nozzle guides air between a top sheet P and a second sheet P, which are floating, of the bundle of sheets P to separate the top sheet P from the bundle of sheets P. The levitation blower 15 sends air to the levitation nozzle. The separation blower 16 sends air to the separation nozzle.

The air blown from the levitation nozzle is referred to as levitation air and the air blown from the separation nozzle is referred to as separation air. The levitation air is blown in the direction indicated by arrow a1 in FIG. 3 from the position facing the leading end (the downstream end in the feed direction) of the upper portion of the bundle of sheets P and is blown onto the leading end (the downstream end in the feed direction) of the upper portion of the bundle of sheets P. The separation air is blown in the direction indicated by arrow a2 in FIG. 3 from the position facing the leading end (the downstream end in the feed direction) of the upper portion of the bundle of sheets P and is blown between the top sheet P attracted to the suction belt 21 and the second sheet P which is floating.

The side blower units 14 are disposed in a pair of side fences 13 that regulates the position of the bundle of sheets P in the width direction, respectively, and blow air onto side faces of the upper portion of the bundle of sheets P in the direction indicated by arrow b in FIG. 3. The side blower unit 14 includes a side levitation nozzle and a side levitation blower 14*a*. The side levitation nozzle guides air in the direction to separate and levitate the bundle of sheets P. The side levitation blower 14*a* sends air to the side levitation nozzle. The air blown from the side levitation nozzle in the direction indicated by arrow b in FIG. 3 is referred to as side air. The side air is discharged from a discharge port 13*a* disposed at the position facing the upper portion of the bundle of sheets P in each of the side fences 13 and is blown onto the side face of the upper portion of the bundle of sheets P. The air blown from the front blower unit 12 and the discharge ports 13*a* of the pair of side fences 13 levitates the upper sheets P of the bundle of sheets P.

The accommodation tray 10 further includes an end fence 25 to align the trailing end of the bundle of sheets P stacked on the sheet loading table 11. A lift 19 as a table moving device moves the sheet loading table 11 up and down in the direction indicated by arrow B in FIG. 3.

Figure 4:
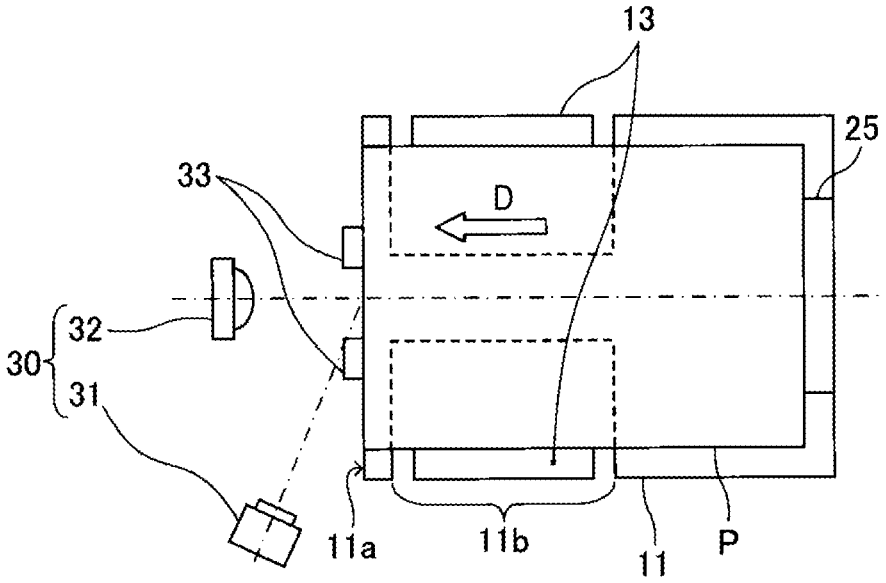
FIG. 4 is a schematic plan view of the accommodation tray.

FIG. 4 is a schematic plan view of the accommodation tray 10. A pair of regulation plates 33 that aligns the leading end of the bundle of sheets P is disposed downstream from the accommodation tray 10 in the direction of conveyance of the sheet P indicated by arrow D in FIG. 4. The leading end of the bundle of sheets P stacked on the sheet loading table 11 contacts the regulation plates 33, thereby regulating the position of the leading end of the bundle of sheets P and positioning the bundle of sheets P. The sheet loading table 11 of the accommodation tray 10 illustrated in FIG. 4 has cut-out portions 11*b* so that the side fences 13 can move in the width direction according to the width of the sheets P stacked on the sheet loading table 11. The cut-out portions 11*b* can be omitted when the accommodation tray 10 is exclusively used for sheets P having a predetermined width or includes another configuration to move the side fences 13 in the width direction.

An imaging device 30 is disposed downstream from the accommodation tray 10 in the direction of conveyance of the sheet P indicated by arrow D in FIG. 4. The imaging device 30 captures an image of an end face 11*a* of the sheet loading table 11 on the downstream side in the direction of conveyance of the sheet P. The imaging device 30 includes an image sensor 31 serving as an imaging unit such as a charge-coupled device (CCD) and a light source 32 serving as an illumination unit such as a light emitting diode (LED) to illuminate the imaging range of the image sensor 31.

Since the interior of the sheet feeding device 200 is covered with an exterior cover, the interior of the sheet feeding device 200 is dark. Therefore, the image sensor 31 alone does not accurately discriminate a belt suction surface 21*a* (see FIG. 5A), the sheet P which is floating, the upper portion of the bundle of sheets P, and the like based on the image captured by the image sensor 31. Therefore, the light source 32 that illuminates the imaging range of the image sensor 31 is provided. The light source 32 is unnecessary when a bypass feeding unit that is not covered with the exterior cover is used or a high-sensitivity camera is used as an imaging unit. The light source 32 is arranged at the center in the width direction of the sheet P so as to illuminate the center portion of the sheet P whose image is captured by the image sensor 31 in the width direction. The image sensor 31 is arranged on one side in the width direction of the sheet P so that the imaging surface of the image sensor 31 faces the center portion of the leading end of the sheet P in the width direction.

Figure 5A:
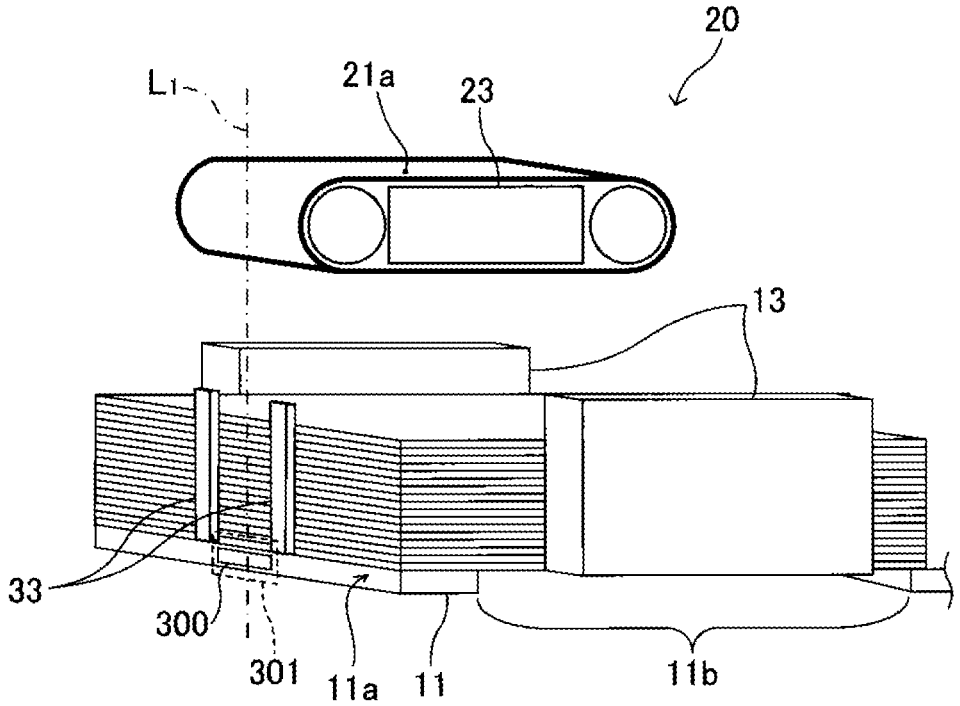
FIGS. 5A to 5C are schematic views illustrating an end face of a sheet loading table of the accommodation tray.
Figure 5B:
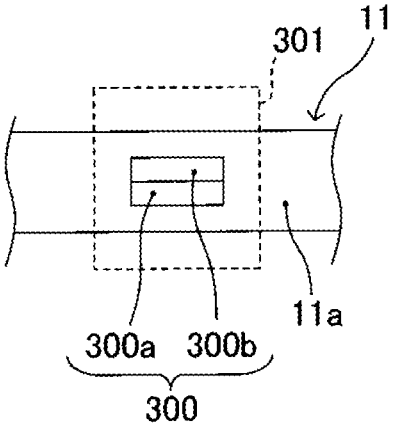
Figure 5C:
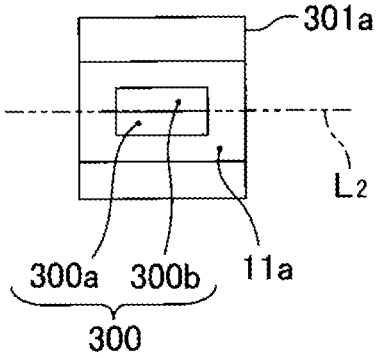

FIGS. 5A to 5C are schematic views illustrating the end face 11*a* of the sheet loading table 11. FIG. 5A is a perspective view illustrating the vicinity of the end face 11*a*, FIG. 5B is a partial enlarged view of the end face 11*a*, and FIG. 5C is an explanatory view illustrating an image processing range 301*a* of the end face 11*a*. As illustrated in FIG. 5A, an identification mark 300 as an identification portion is disposed at the center of the end face 11*a* in the width direction. Line $L_1$ in FIG. 5A indicates the center in the width direction. The imaging device 30 captures an image in an imaging range 301 indicated by the broken line in FIGS. 5A and 5B.

FIG. 5B is an example of the identification mark 300. The identification mark 300 includes an upper region 300*a* and a lower region 300*b* having different optical densities or colors, respectively. The boundary line between the upper region 300*a* and the lower region 300*b* represents the position of the sheet loading table 11 in the vertical direction. The identification mark 300 is not limited to the above example as long as the position of the sheet loading table 11 in the vertical direction can be identified based on the image captured by the imaging device 30. Various patterns, for example, including plain different colors can be used as an identification mark. Note that the sheet loading table 11 moves in the vertical direction (i.e., the direction of movement of the sheet loading table 11).

FIG. 5C illustrates an image corresponding to the image processing range 301*a* in the imaging range 301 captured by the imaging device 30. In FIG. 5C, the boundary line of the identification mark 300 coincides with the line $L_2$ indicating the center of the image processing range 301*a* in the vertical direction. Even when the sheet loading table 11 is moved up and down by the lift 19 to change the height of the sheet loading table 11, an imaging range changer is provided to change the imaging range 301 of the imaging device 30 so as to capture the boundary line of the identification mark 300 at the center of the image processing range 301*a* in the vertical direction.

Figure 6A:
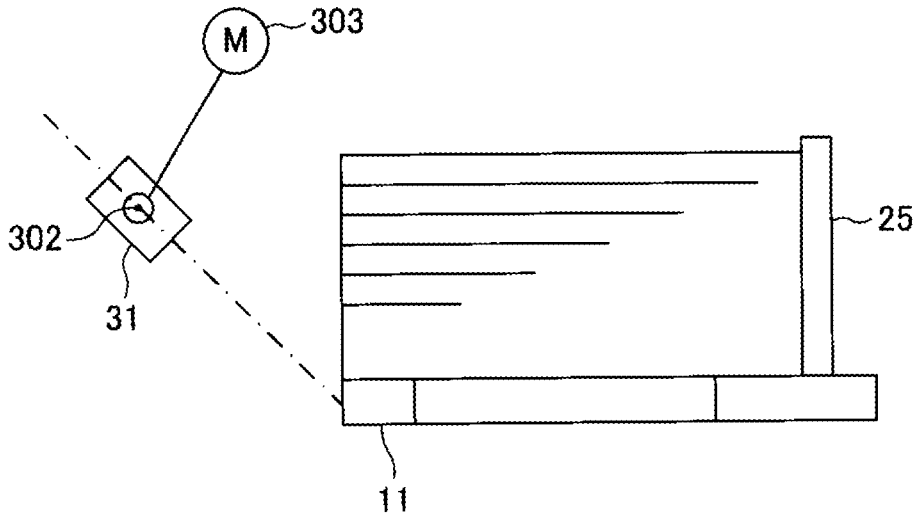
FIGS. 6A and 6B are schematic views illustrating an example of an imaging range changer of the sheet feeding device.
Figure 6B:
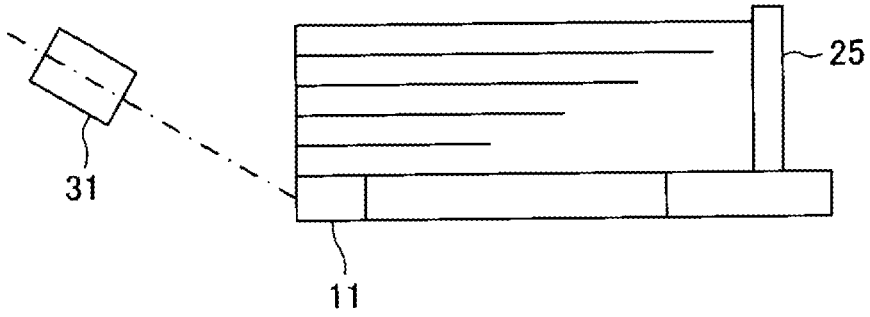

FIGS. 6A and 6B illustrates an example of the imaging range changer. In this example, the image sensor 31 is swung around a swing center shaft 302 to change the imaging range 301 in the vertical direction as illustrated in FIGS. 6A and 6B, such that the image sensor 31 is angled 45 degrees below to the horizontal direction in FIG. 6A and the image sensor 31 is angled 30 degrees below to the horizontal direction in FIG. 6B. An imaging motor 303 as an example of the imaging range changer swings the image sensor 31. In the example illustrated in FIGS. 6A and 6B, the position of the swing center shaft 302 overlaps with the position of the image sensor 31 but is not limited to the above arrangement. In any case, the relation between the swing angle of the image sensor 31 around the swing center shaft 302 and the height of the sheet loading table 11 is defined by the set position of the swing center shaft 302. With this relation, the height of the sheet loading table 11 can be detected based on the swing angle.

It is assumed that, when the swing angle is 45 degrees as illustrated in FIG. 6A, the sheet loading table 11 is located at the height at which the sheets P corresponding to the maximum load capacity are stacked on the sheet loading table 11. As the image sensor 31 is swung around the swing center shaft 302, the boundary line of the identification mark 300 is aligned with the line $L_2$ indicating the center of the image processing range 301*a* in the vertical direction to detect the sheet loading table 11, for example, at the swing angle of 30 degrees as illustrated in FIG. 6B. The remaining amount of the sheets P can be calculated such that the height of the sheet loading table 11 with the swing angle of 30 degrees corresponds to, for example, the remaining amount of 67% of the maximum load capacity.

Figure 7A:
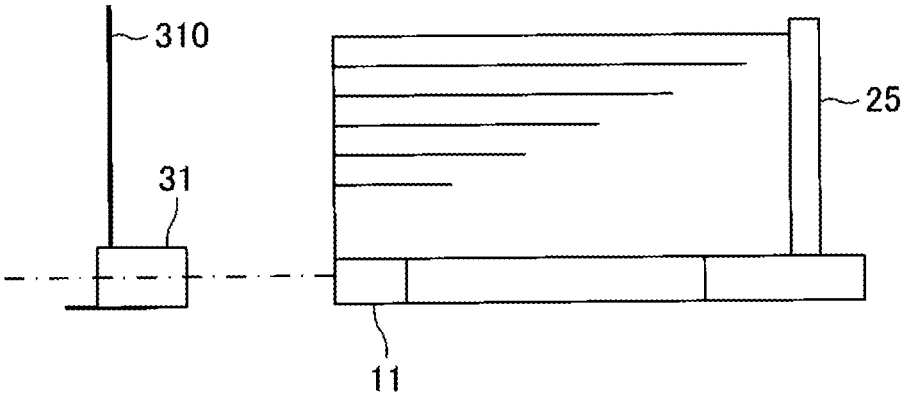
FIGS. 7A and 7B are schematic views illustrating another example of the imaging range changer.
Figure 7B:
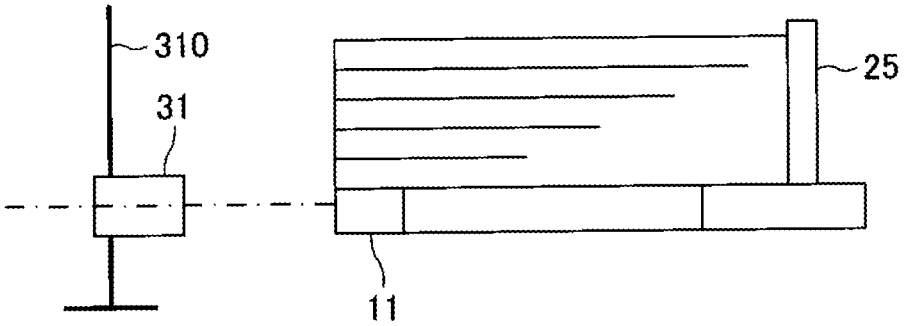

FIGS. 7A and 7B illustrates another example of the imaging range changer. In this example, the image sensor 31 is movable up and down along a guide 310 extending in the vertical direction. As the image sensor 31 is moved up and down along the guide 310, the boundary line of the identification mark 300 is aligned with the line L2 indicating the center of the image processing range 301*a* in the vertical direction, thereby detecting the sheet loading table 11. Also in this example, the height of the sheet loading table 11 can be detected based on the height of the image sensor 31 by using the relation between the height of the image sensor 31 and the height of the sheet loading table 11.

The change of the imaging range 301 by the change of the posture or the movement of the image sensor 31 is not limited to the examples in FIGS. 6A and 6B and FIGS. 7A and 7B, and various motions of the image sensor 31 that can change the imaging range 301 can be adopted. When the posture of the image sensor 31 is changed or the image sensor 31 is moved by a stepping motor, the amount of the posture change or the amount of movement of the image sensor 31 can be calculated by counting the drive pulse of the stepping motor. Further, when the posture of the image sensor 31 is changed or the image sensor 31 is moved by a servo motor, the amount of the posture change or the amount of movement of the image sensor 31 can be calculated by detecting the amount of rotational drive of the servo motor by an encoder. Not limited to the above, the amount of the posture change or the amount of movement of the image sensor 31 can be directly detected by a mechanical or optical instrument.

The imaging device 30 for detecting the height of the sheet loading table 11 described with reference to FIGS. 6A and 6B and FIGS. 7A and 7B can also be used as a detection device for various controls.

Figure 8A:
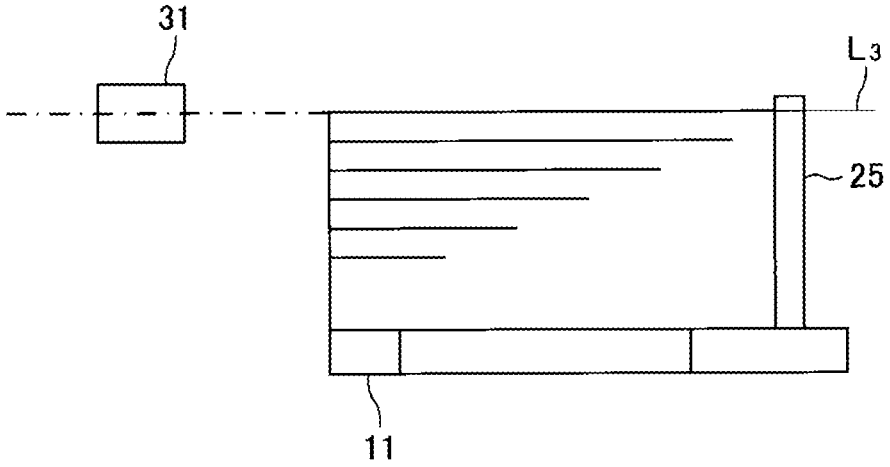
FIGS. 8A and 8B are schematic views of the sheet feeding device when an imaging device thereof is used for another control.
Figure 8B:
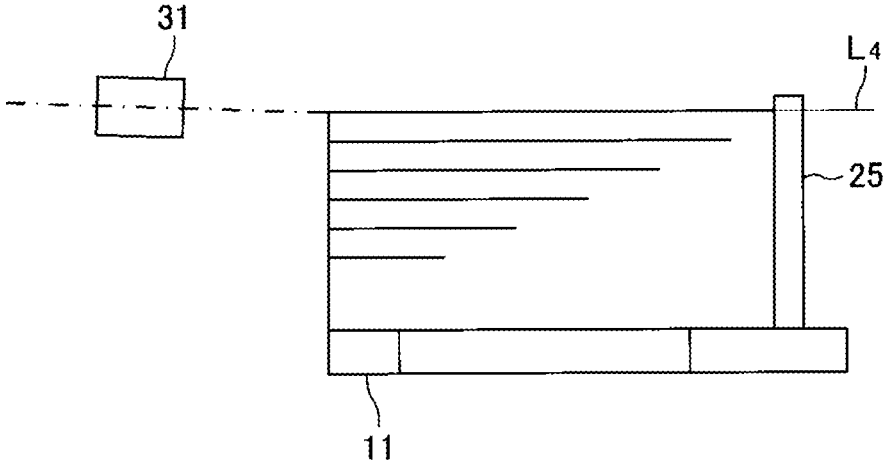

FIGS. 8A and 8B are explanatory views in the case in which the imaging device 30 for detecting the height of the sheet loading table 11 described with reference to FIGS. 6A and 6B is also used for lifting control to lift and lower the sheet loading table 11 by the lift 19. In the lifting control of the sheet loading table 11, the position of the top sheet P levitated by air blow and the density of the sheets P that are floating in the region where the sheets P can be levitated are detected. Alternatively, the position of the top sheet P of the bundle of sheets P that is not floating is detected while air blows or when air blow is stopped. Then, the height of the sheet loading table 11 is controlled so as to optimize air separation of the sheet P. These positions can be detected by the imaging device 30 for detecting the height of the sheet loading table 11.

FIG. 8A is an explanatory view illustrating a state in which the position of the top sheet P of the bundle of sheets P, which is not floating, is detected for the lifting control of the sheet loading table 11 while air blow is stopped. In this lifting control, the image sensor 31 takes a posture to capture a position $L_3$ of the top sheet P in the horizontal direction. The sheet loading table 11 is lifted or lowered so that the image sensor 31 in such a posture captures the top sheet P at the center of the imaging range 301 in the vertical direction.

FIG. 8B illustrates the posture of the image sensor 31 when a position $L_4$, which is lower than the position $L_3$ in FIG. 8A, is the target height of the top sheet P for the lifting control. When plain paper is used as the sheet P, the image sensor 31 is angled 0 degree to the horizontal direction, and the height of the sheet loading table 11 is controlled so that the image sensor 31 detects the position $L_3$ of the top sheet P as illustrated in FIG. 8A. When thin paper is used as the sheet P, the image sensor 31 is angled, for example, 3 degrees below to the horizontal direction, and the height of the sheet loading table 11 is controlled so that the image sensor 31 detects the position $L_4$ of the top sheet P as illustrated in FIG. 8B. Since thin paper is easily levitated by air blow, the position of the top sheet P of the bundle of sheets P is set to a relatively low position as compared with the case of plain paper. Thus, the posture or position of the image sensor 31 is changed to change the imaging range, thereby appropriately setting the position of the top sheet P according to the thickness of the sheet P. That is, top sheet P of the bundle of sheets P can be located at a predetermined height according to the thickness of the sheet P by the lift 19 that lifts and lowers the sheet loading table 11. As described above, the posture or position of the image sensor 31 is changed so as to switch between the imaging range to capture the identification mark 300 and the imaging range to capture the top sheet P of the bundle of sheets P.

Information of the thickness of the sheet P is obtained by a sheet data acquisition device that acquires sheet data, such as sheet type data input by an user using a control panel 67*a* (see FIG. 11) of the apparatus body 100 of the image forming apparatus 1 or data from the sheet type detector 70 (see FIG. 11) disposed in the sheet feeding device 200 of the image forming apparatus 1 to detects the type of the sheet P. A controller 66 (see FIG. 11) described later serves as the sheet data acquisition device.

Figure 9A:
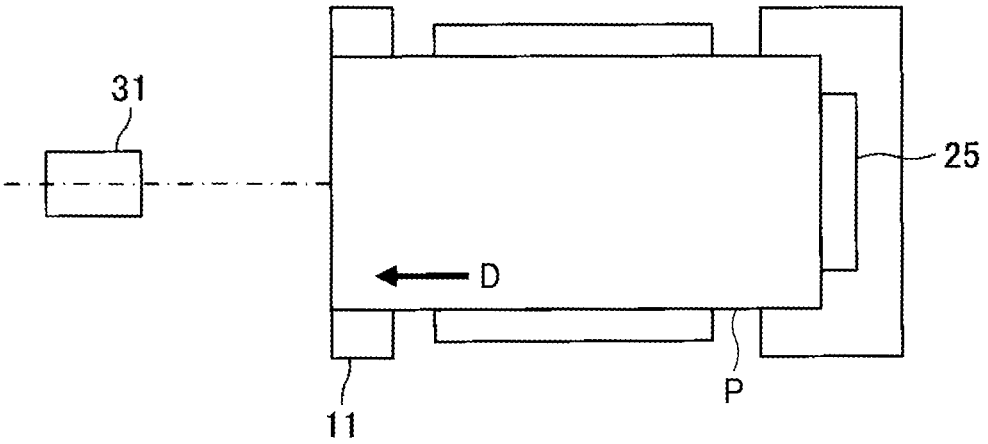
FIGS. 9A and 9B are schematic views of the sheet feeding device when the imaging device is used for yet another control.
Figure 9B:
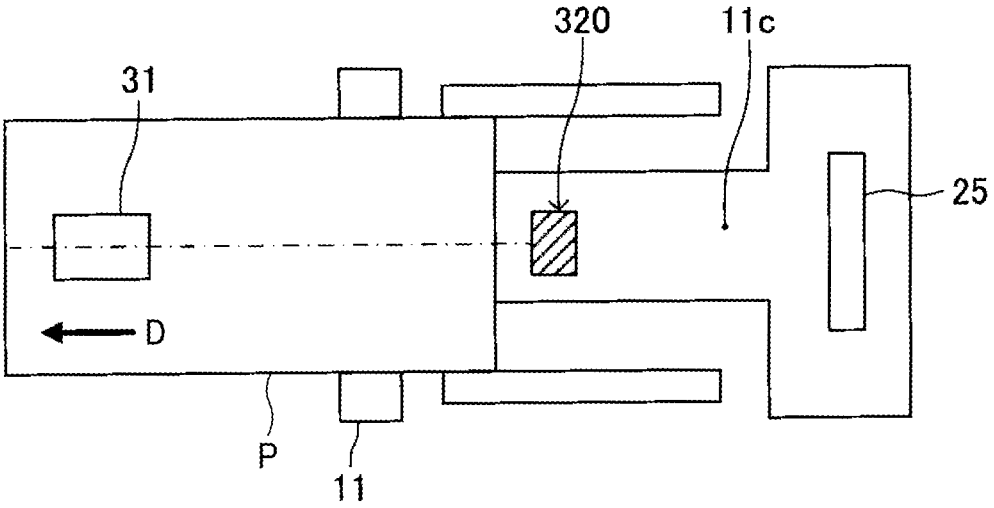

FIGS. 9A and 9B are explanatory views in the case in which the imaging device 30 for detecting the height of the sheet loading table 11 described with reference to FIGS. 6A and 6B is also used for detecting the presence or absence of the sheet P on the sheet loading table 11. FIG. 9A is a plan view of the sheet loading table 11 when the sheet P is present on the sheet loading table 11, and FIG. 9B is a plan view of the sheet loading table 11 when the sheet P is not present on the sheet loading table 11. As illustrated in FIG. 9B, a sheet end pattern 320 is provided on a sheet loading surface 11*c* of the sheet loading table 11. The sheet end pattern 320 as another identification mark can be identified by the imaging device 30. The controller 66 detects the presence or absence of the sheet P depending on whether or not the sheet end pattern 320 can be detected based on the image captured by the imaging device 30.

In a comparative example, a sheet detection sensor is disposed at the upper portion of the sheet loading table. The sheet detection sensor detects the presence or absence of the sheet P when the sheet loading table is located at the highest position in the range where the sheet loading table is movable. With this configuration, in order to detect the presence or absence of the sheet P, a preliminary operation of moving the sheet loading table to the highest position is required each time. On the other hand, in the present embodiment illustrated in FIGS. 9A and 9B, the controller 66 can detect the presence or absence of the sheet P just by changing the posture or position of the image sensor 31 so that the image sensor 31 can capture the sheet end pattern 320 on the sheet loading surface 11*c* in the imaging range 301. Therefore, the configuration in the present embodiment can reduce the preliminary operation for detecting the presence or absence of the sheet P.

Figure 10A:
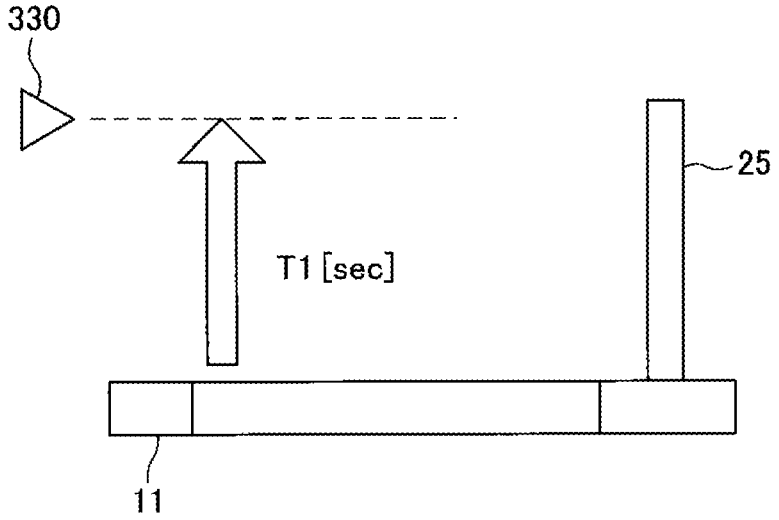
FIGS. 10A and 10B are schematic views of the sheet feeding device when the imaging device is used for still yet another control.
Figure 10B:
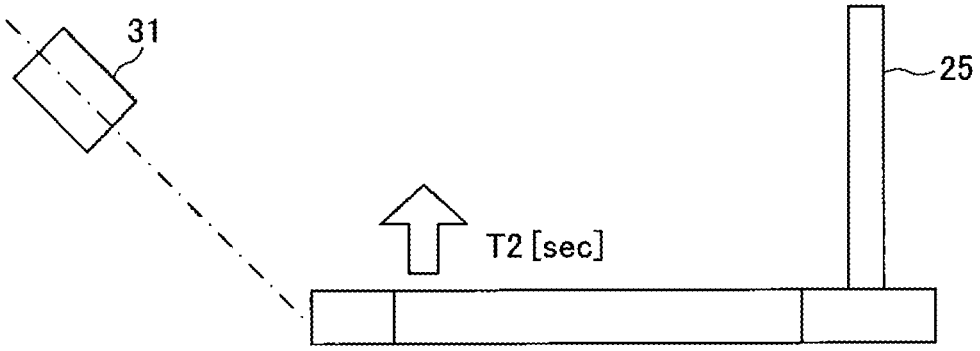

FIGS. 10A and 10B are explanatory views of the sheet feeding device 200 in the case in which the imaging device 30 for detecting the height of the sheet loading table 11 described with reference to FIG. 6 is also used for detecting the abnormality of the lift 19 that lifts and lowers the sheet loading table 11. FIG. 10A is the explanatory view illustrating the abnormality detection of the lift 19 in the comparative example. The abnormality of the lift 19 is a state in which the sheet loading table 11 does not move up and down even if the controller 66 commands the lift 19 to lift or lower the sheet loading table 11. The abnormality of the lift 19 is caused by a failure of the motor as a drive source, a failure of a transmission mechanism of the driving force from the drive source, and the like.

In the comparative example, as illustrated in FIG. 10A, the controller 66 detects the abnormality of the lift 19 using a top position sensor 330 that detects the position of the top sheet P of the bundle of sheets P on the sheet loading table 11 as follows. The controller 66 commands the lift 19 to lift the sheet loading table 11 from the lower position to the detectable position where the top position sensor 330 can detect the sheet loading table 11. After that, the controller 66 waits for, for example, 1.5 times the required time T1 when the sheet loading table 11 moves from the lower position to the detectable position by the top position sensor 330. The controller 66 detects the abnormality of the lift 19 based on whether or not the sheet loading table 11 is detected by the top position sensor 330 within 1.5 times the required time T1. Therefore, for example, 1.5 times the required time T1 was required for waiting time.

On the other hand, in the imaging device 30 for detecting the height of the sheet loading table 11 illustrated in FIGS. 6A and 6B, the controller 66 changes the posture of the image sensor 31 so as to capture the identification mark 300 of the sheet loading table 11 in the center of the image processing range 301*a* in the vertical direction. Therefore, after commanding the lift 19 to lift or lower the sheet loading table 11, the controller 66 detects the abnormality of the lift 19 using the imaging device 30 illustrated in FIGS. 6A and 6B based on whether or not the posture of the image sensor 31 changes. For example, the controller 66 can detect the abnormality of the lift 19 based on whether or not the posture of the image sensor 31 changes (i.e., whether or not the height of the sheet loading table 11, which is detected by the image sensor 31, changes) within the required time T2. Note that the required time T2 is sufficiently shorter than the required time T1. That is, since the image sensor 31 recognizes the position of the sheet loading table 11, if the posture of the image sensor 31 does not change when the controller 66 commands the lift 19 to lift the sheet loading table 11, the controller 66 can detect the abnormality of the lift 19 in the minimum time (e.g., the required time T2).

Figure 11:
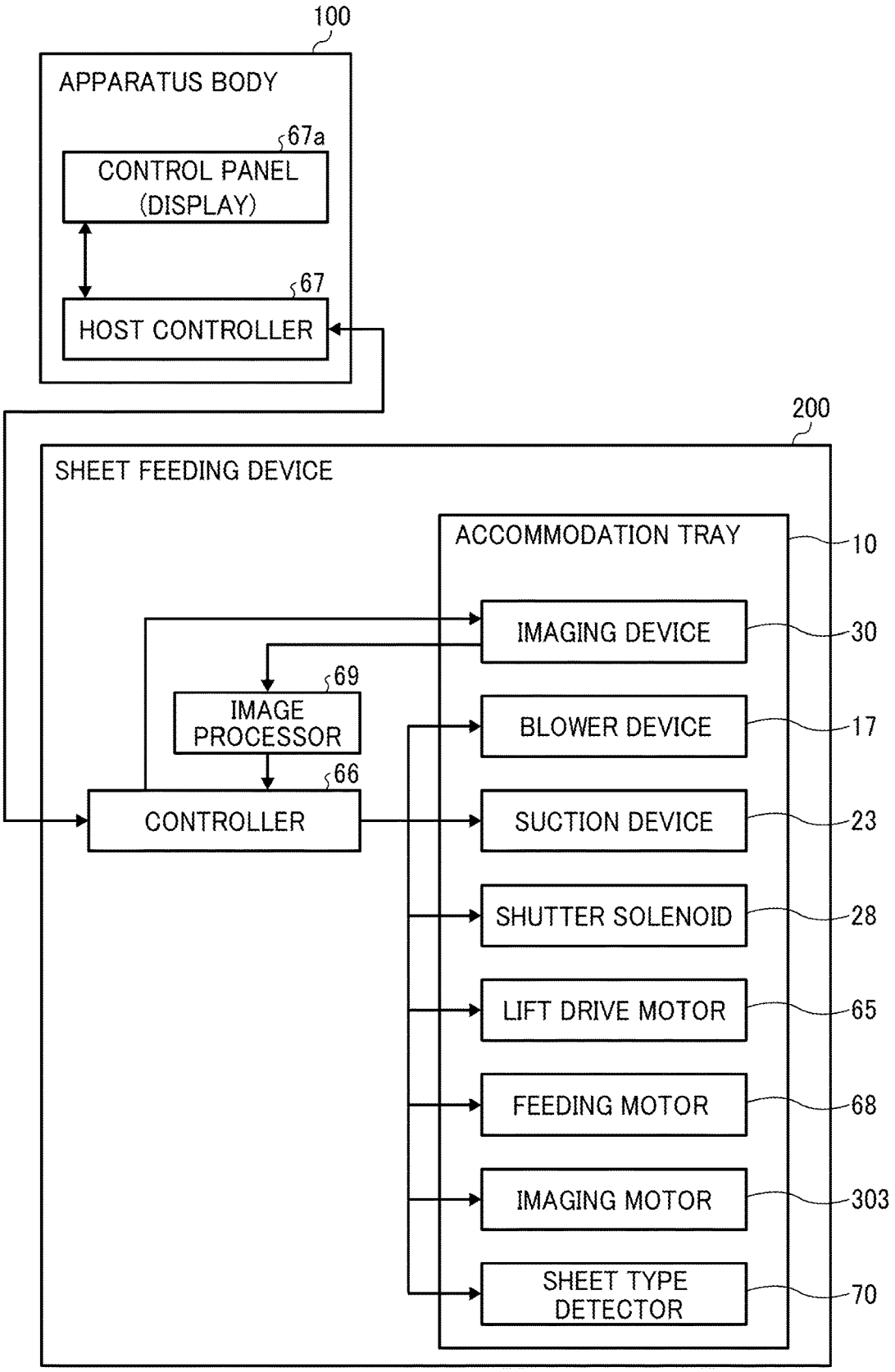
FIG. 11 is a block diagram illustrating an example of a part of control system of the image forming apparatus.

FIG. 11 is a block diagram illustrating an example of a part of control system of the image forming apparatus 1. The imaging device 30 is connected to the controller 66, which is implemented, for example, circuitry, of the sheet feeding device 200. Specifically, the image sensor 31 and the light source 32 of the imaging device 30 are connected to the controller 66. The imaging motor 303 for changing the posture and position of the image sensor 31 to change the imaging range 301 is also connected to the controller 66. Further, the sheet feeding device 200 includes an image processor 69 that processes the image captured by the image sensor 31.

The blower device 17 and the suction device 23 are also connected to the controller 66. Further, a shutter solenoid 28 for opening and closing a shutter for the levitation air and a lift drive motor 65 of the lift 19 for lifting and lowering the sheet loading table 11 are also connected to the controller 66. Furthermore, a feeding motor 68 for driving the suction belt 21 of the feeding unit 20 is connected to the controller 66 of the sheet feeding device 200. The controller 66 of the sheet feeding device 200 is connected to a host controller 67 of the apparatus body 100 of the image forming apparatus 1. The host controller 67 is connected to various devices such as the control panel (display) 67*a* of the apparatus body 100.

The controller 66 detects the height of the sheet loading table 11 based on the image captured by the imaging device 30. The detection result of the height can be used for detecting the remaining amount of the sheets P and displaying the remaining amount on the control panel (display) 67*a* illustrated in FIG. 11. In addition, the detection result can be used for the various controls described above. That is, the detection result can be used for the lifting control of the sheet loading table 11 by the lift 19, the control of the detection of presence or absence of the sheet P, and the control of the detection of the abnormality of the lift 19. Further, the controller 66 controls the side levitation blowers 14*a*, the levitation blower 15, and the separation blower 16 of the blower device 17 based on the image captured by the image sensor 31 of the imaging device 30, thereby regulating the volumes of the levitation air, the separation air, and the side air. Furthermore, the controller 66 causes the feeding motor 68 to feed the top sheet P attracted to the suction belt 21 based on the image captured by the image sensor 31 of the imaging device 30.

The amount of the lifting control of the lift 19 can be changed according to the height of the sheet loading table 11 detected based on the image captured by the imaging device 30. In the comparative example, when the remaining amount of the sheets P is low, the amount of the lifting control (the amount of movement of the sheet loading table 11) is switched from that of the previous time (i.e., when the remaining amount of the sheets P is not low). For example, the sheet loading table 11 may be lifted to the high position where the sheet loading table 11 partially blocks the levitation air, or the density of the sheets P may become too low in the region where the sheets P can float because the sheets P are easily levitated when the remaining amount of the sheets P is low. Accordingly, the sheet P may not be fed reliably. To prevent the above situation, when the remaining amount of sheets P is low, the amount of the lift control is switched so that the position of the sheet loading table 11 is higher than the position when the remaining amount of the sheets P is not low. Similarly to the comparative example, in the present embodiment, the amount of the lifting control of the lift 19 can be switched. Alternatively, the position of the sheet loading table 11 may be preferably lower than the position when the remaining amount of the sheets P is not low depending on the specific shape of the sheet loading table 11 or the positional relation with the air nozzles (e.g., the levitation nozzle, the separation nozzle, or the side levitation nozzle). In any case, the lifting control can be switched according to the detected height of the sheet loading table 11.

In the above embodiments, the image sensor 31 is provided so that the imaging range 301 can be changed. Alternatively, an imaging range may be fixed when an image sensor can capture the entire range required for the various controls within the imaging range. For example, the image sensor can capture the entire range from the sheet loading table 11 at the lowest position illustrated in FIG. 5A to the lower surface of the suction belt 21 to which the sheet P is attracted within the imaging range. In this case, the actual height of the sheet loading table 11 in the sheet feeding device 200 can be detected based on the position of the identification mark 300 in the image processing range 301*a* of the image processor 69. This is because the correspondence between the position of the identification mark 300 in the image processing range 301*a* and the actual height of the sheet loading table 11 in the sheet feeding device 200 can be obtained in advance.

In the above embodiments, the suction belt 21 and the suction device 23 are used as a conveyor of the feeding unit 20. Instead of the suction belt 21 and the suction device 23, a conveyor employing a friction retard roller (FRR) method can be used. Further, although the air separation method is adopted for separating the top sheet P, another separation method may be adopted.

As described above, according to the present disclosure, the accuracy of detecting the position of the sheet loading table can be improved as compared with the comparative example.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

What is claimed is:

1. A sheet feeding device comprising:

a sheet loading table on which a bundle of sheets is stacked;

an identification mark on an end face of the sheet loading table;

an image capturer to identify the identification mark; and an imaging range changer to change an imaging range of the image capturer in a direction of movement of the sheet loading table.

2. The sheet feeding device according to claim 1, further comprising a table mover to move the sheet loading table.

3. The sheet feeding device according to claim 2, further comprising circuitry to detect abnormality of the table mover based on an image captured by the image capturer.

4. The sheet feeding device according to claim 1, wherein the table mover moves the sheet loading table so that a top sheet of the bundle of sheets is located at a predetermined height, and wherein the imaging range changer changes the imaging range to capture the identification mark in the imaging range.

5. The sheet feeding device according to claim 4, wherein the imaging range changer switches between the imaging range to capture the identification mark in the imaging range and the imaging range to capture the top sheet in the imaging range.

6. The sheet feeding device according to claim 5, further comprising:

a blower to blow air onto the bundle of sheets to levitate upper sheets of the bundle of sheets;

a feeder to feed the top sheet in the upper sheets levitated by the blower device; and circuitry configured to acquire sheet data of the bundle of sheets, wherein the imaging range changer changes the imaging range to capture the top sheet based on the sheet data.

7. The sheet feeding device according to claim 1, further comprising:

a table mover to move the sheet loading table so that a top sheet of the bundle of sheets is located at a predetermined height;

a blower to blow air onto the bundle of sheets to levitate upper sheets of the bundle of sheets;

a feeder to feed the top sheet in the upper sheets levitated by the blower; and circuitry configured to control at least one of a volume of the air blown by the blower and an amount of movement of the sheet loading table by the table mover based on an image captured by the image capturer.

8. The sheet feeding device according to claim 1, further comprising another identification mark on a sheet loading surface of the sheet loading table, wherein the image capturer identifies said another identification mark.

9. The sheet feeding device according to claim 1, further comprising an illuminator to illuminate an imaging range of the image capturer.

10. An image forming apparatus comprising:

an image former to form an image on a sheet; and the sheet feeding device according to claim 1 to feed the sheet to the image former.

* * * * *